US005386804A

United States Patent [19]

Guttmann et al.

[11] Patent Number: 5,386,804

[45] Date of Patent: Feb. 7, 1995

[54] PROCESS FOR THE ADDITION OF FERROCENE TO COMBUSTION OR MOTOR FUELS

[75] Inventors: Hansjuergen Guttmann, Schermbeck; Dieter Hoehr, Wesel; Heinz-Kuno Schaedlich, Essen; Kurt-Peter Schug, Dorsten; Walter Thuenker, Bottrop, all of Germany

[73] Assignee: Veba Oel Aktiengesellschaft, Gelsenkirchen, Germany

[21] Appl. No.: 978,755

[22] Filed: Nov. 19, 1992

[30] Foreign Application Priority Data

Nov. 21, 1991 [DE] Germany ..... 4138216

[51] Int. Cl.[6] ..... F02B 75/12

[52] U.S. Cl. ..... 123/1 A; 123/23; 44/361; 431/4

[58] Field of Search ..... 44/361; 123/1 A, 23; 431/4

[56] References Cited

U.S. PATENT DOCUMENTS

| | | | |
|---|---|---|---|
| 2,835,686 | 5/1958 | Graham | 44/361 |
| 2,867,516 | 1/1959 | Pedersen . | |
| 3,160,592 | 12/1964 | Brown . | |
| 3,341,311 | 9/1967 | Pedersen et al. | 44/361 |
| 3,783,841 | 1/1974 | Hirschler, Jr. et al. | 123/1 A |
| 3,886,007 | 5/1975 | Combs, Jr. et al. | 149/19.2 |
| 3,927,992 | 12/1975 | Kerley . | |
| 4,070,212 | 1/1978 | Mackey et al. | 149/19.9 |
| 4,222,746 | 9/1980 | Sweeney et al. | 123/1 A |
| 4,295,816 | 10/1981 | Robinson | 431/4 |
| 4,318,760 | 3/1982 | Stephens et al. | 149/19.9 |
| 4,389,220 | 6/1983 | Kracklauer | 44/57 |
| 4,416,710 | 11/1983 | Anderson | 149/19.91 |
| 4,525,174 | 6/1985 | Croudace | 123/1 A |
| 4,612,880 | 9/1986 | Brass et al. | 123/1 A |
| 4,908,048 | 3/1990 | Farrar | 44/361 |
| 4,946,609 | 8/1990 | Pruess et al. | 252/35 |
| 4,955,331 | 9/1970 | Hohr et al. | 123/1 A |
| 4,998,876 | 3/1991 | Farrar | 431/4 |
| 5,113,804 | 5/1992 | Kraus et al. | 123/1 A |
| 5,118,282 | 6/1992 | Reynolds et al. | 431/4 |
| 5,235,936 | 8/1993 | Kracklauer | 123/1 A |

FOREIGN PATENT DOCUMENTS

| | | |
|---|---|---|
| 0375303 | 6/1990 | European Pat. Off. . |
| 0543477A2 | 5/1993 | European Pat. Off. . |
| 1078519 | 11/1954 | France . |
| 1090321 | 3/1955 | France . |
| 767839 | 5/1971 | France . |
| 3715473 | 8/1988 | Germany . |
| 3801947A1 | 8/1989 | Germany . |
| 3801947C2 | 6/1990 | Germany . |
| 4129408 | 10/1992 | Germany . |

*Primary Examiner*—E. Rollins Cross
*Assistant Examiner*—Erick Solis
*Attorney, Agent, or Firm*—Oblon, Spivak, McClelland, Maier, & Neustadt

[57] ABSTRACT

A process for the addition of ferrocene to combustion or motor fuels involves an improved metering of the additive ferrocene into the combustion chamber of an internal combustion engine or a combustion system. The process utilizes the sublimation properties of ferrocene in that ferrocene is passed through sublimation into a stream of combustion gas or a substream thereof and with the combustion or motor fuel, which is present as a vapor or finely distributed as solid or liquid particles, fed to a chemical conversion through combustion. A preferred application consists of loading the combustion chamber of a diesel engine equipped with a diesel particulate filter with a carrier gas stream enriched with ferrocene vapor in a sublimator.

17 Claims, 5 Drawing Sheets

PROCESS FOR THE ADDITION OF FERROCENE TO COMBUSTION OR MOTOR FUELS

BACKGROUND OF THE INVENTION

1. Field of the Invention

The invention relates to a process for the addition of ferrocene to combustion or motor fuels in order to improve their combustion with atmospheric oxygen or oxygen-containing gases.

2. Description of the Related Art

To reduce the consumption of combustion or motor fuels, to decrease emissions during the combustion of combustion or motor fuels and to remove or reduce the carbon deposits when motor vehicle engines are running, liquid hydrocarbon mixtures, comprising in essence gasoline and an organometallic compound from the group of [bis($\eta$-cyclopentadienyl)-iron], called ferrocene in the following, and gasoline-soluble derivatives of ferrocene have been proposed (see DE-OS 25 02 307).

Furthermore, for the purpose of reducing the consumption of motor fuel and the exhaust emission in an Otto engine equipped with an exhaust gas catalyst system for exhaust gas afterburning, the use of a liquid motor fuel with an addition of 1 to 100 ppm by wt. of ferrocene has been proposed (see DE 38 01 947 A1).

For the purpose of avoiding unreliably high exhaust gas back pressure when running a diesel engine equipped with a particulate filter in the exhaust stream, the use of a motor lubricant, to which a catalytically effective content, amounting to 5 to 20,000 ppm, of an iron compound is added, has been proposed. Among others, ferrocene was taken into consideration as the iron compound (see DE 38 09 307 A1).

In an earlier German patent application P 41 29 408, a device and a process for the direct addition of a solid additive—ferrocene—to liquid motor fuels have been proposed, where, controlled by means of pulverizing ferrocene compacts, ferrocene is added to the liquid fuel in metered amounts.

All of these methods have in common that here an addition to the liquid fuel or even combustion fuel, e.g., heating oil, was effected, utilizing the solubility properties of the added additive, here ferrocene or ferrocene derivatives. The same also applies to the addition to the motor lubricant, which can take place by directly dissolving or also by preparing concentrated solvents in solvents compatible with the motor lubricant and by their addition to the lubricant.

The preparation of suitable solutions or stock solutions is inconvenient and expensive on account of the required metering and mixing apparatuses and the related operations. In addition, additional measures are required in order to ensure the stability and the specified properties of the motor or combustion fuels to which ferrocene or ferrocene derivatives are added. This kind of metering has also the drawback that the addition of the additive can be optimized only for a specific operating point.

SUMMARY OF THE INVENTION

From the above an object of the present invention is to enable an improved metering of the additive ferrocene into the combustion chamber of a combustion engine or an oil-fired heating system without the preceding admixture as solid or as stock solution to the combustion fuel, motor fuel or lubricant.

The problem is solved by conveying vaporous ferrocene through sublimation into a stream of the combustion gas or a substream thereof and by feeding with the combustion or motor fuel, which is present as a vapor or finely distributed as solid or liquid particles, to the chemical conversion through combustion. The advantageous solution of the problem is based thus on the utilization of the sublimation properties of ferrocene.

This measure offers the advantage that the amount of ferrocene can be readily adjusted with standard measures to the optimally required quantities for the individual different operating states of internal combustion engines.

The compacts or pellets made of ferrocene crystals have dimensions of preferably 1 to 10 mm and are admitted into a sublimator with a carrier gas stream of the combustion gas or by parts of a combustion gas at pressure and temperature values in the range of the interface or coexistence line between the solid and gaseous phase. The ferrocene-containing carrier gas stream is led from there on into the combustion chamber.

Ferrocene is a substance, which precipitates as yellow-orange needles depending on the manufacturing method. Some chemical and physical data are compiled as follows:

| | | |
|---|---|---|
| formula | $Fe(C_5H_5)_2$ | |
| mole mass | 186.04 g/mo[1] | |
| density | 1.49 g/cm$^3$ | |
| melting point | 173° C. | |
| boiling point | 249° C. | 1.035 bar |
| shrivel point | 183° C. | |
| vapor pressure | 0.666 mbar | 40° C. |
| | 3.4 mbar | 100° C. |
| heat of fusion | 17.8 kJ/g mol | 175° C. |
| heat of evaporation | 47.2 kJ/g mol | 175° C. |
| heat of sublimation | 70.2 kJ/g mol | 25° C. |
| decomposition point | 465° C. | |
| magnetic susceptibility diamagnetically | | |

In Römpps Chemielexikon, 9th edition, volume 2, page 1330, the information is given under the keyword ferrocene that it sublimates above 100° C.

However, it has been surprisingly found that already at temperatures below 100° in a suitable sublimator sufficient quantities of ferrocene pass into a carrier gas stream. When the ferrocene-containing carrier gas stream is introduced into the combustion chamber for the purpose of burning, according to specifications, the combustion or motor fuels with atmospheric oxygen or oxygen-containing gases, the results are effects that are better or as good as the effects obtained when additives are added to the liquid fuel itself.

Moldings made of commercially manufactured ferrocene such as pellets, compacts or chips having dimensions ranging from 1 to 10 mm can be received advantageously in a suitable vessel of the sublimator. The ferrocene compacts can be made of ferrocene crystals (purity at least 98.5% by wt.), originating from a crystallizing solution, and wetted with solvent, for example, wetted with ethanol, without the addition of binders or the like.

However, industrially manufactured ferrocene without previous compression into moldings can also be put in correspondingly provided inserts that are permeable to ferrocene vapor such as filter cartridges or the like of air filters for the combustion air of heaters or motor vehicle engines.

Depending on the desired concentration of the ferrocene passed through sublimation into the carrier gas stream, the combustion air functioning as the carrier gas stream can be preheated to a temperature ranging from 20° to 175°, preferably from 50° to 150° C.

Without additional heating, operating states of the sublimator can range, depending on how it is fixed structurally into the engine space or in the space adjacent to the burner of a heater, from about minus 40° C. at cold outer temperatures and unprotected location up to plus 50° C. with suitable heating by means of the burner or engine operation. Of course, it is also possible to provide additional heating for the sublimator, a feature that contributes to the uniformity of the operating behavior even at the start of putting into service.

The pressure prevailing in the sublimator owing to the pressure of the carrier gas stream ranges preferably from 100 mbar to 3 bar.

The pressure and temperature conditions and the geometric dimensions of the sublimator and the quantity of carrier gas can be specified in such a manner that an evaporated quantity of ferrocene ranging from 0.1 to 1,000, preferably from 1 to 100 mg per kg of combustion or motor fuel is produced.

A preferred operating mode is to preheat the carrier gas stream to a temperature ranging from 20° to 175°, preferably from 50° to 150° C.

One application of the present process relates to introducing a ferrocene-containing carrier gas stream into the combustion chamber of a diesel engine. The exhaust gas side of the diesel engine can be equipped with a particulate filter to retain carbon-containing particles contained in the exhaust gas, called by the expert particulates, which stem from the incomplete combustion of the diesel fuel with the combustion air in the engine.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
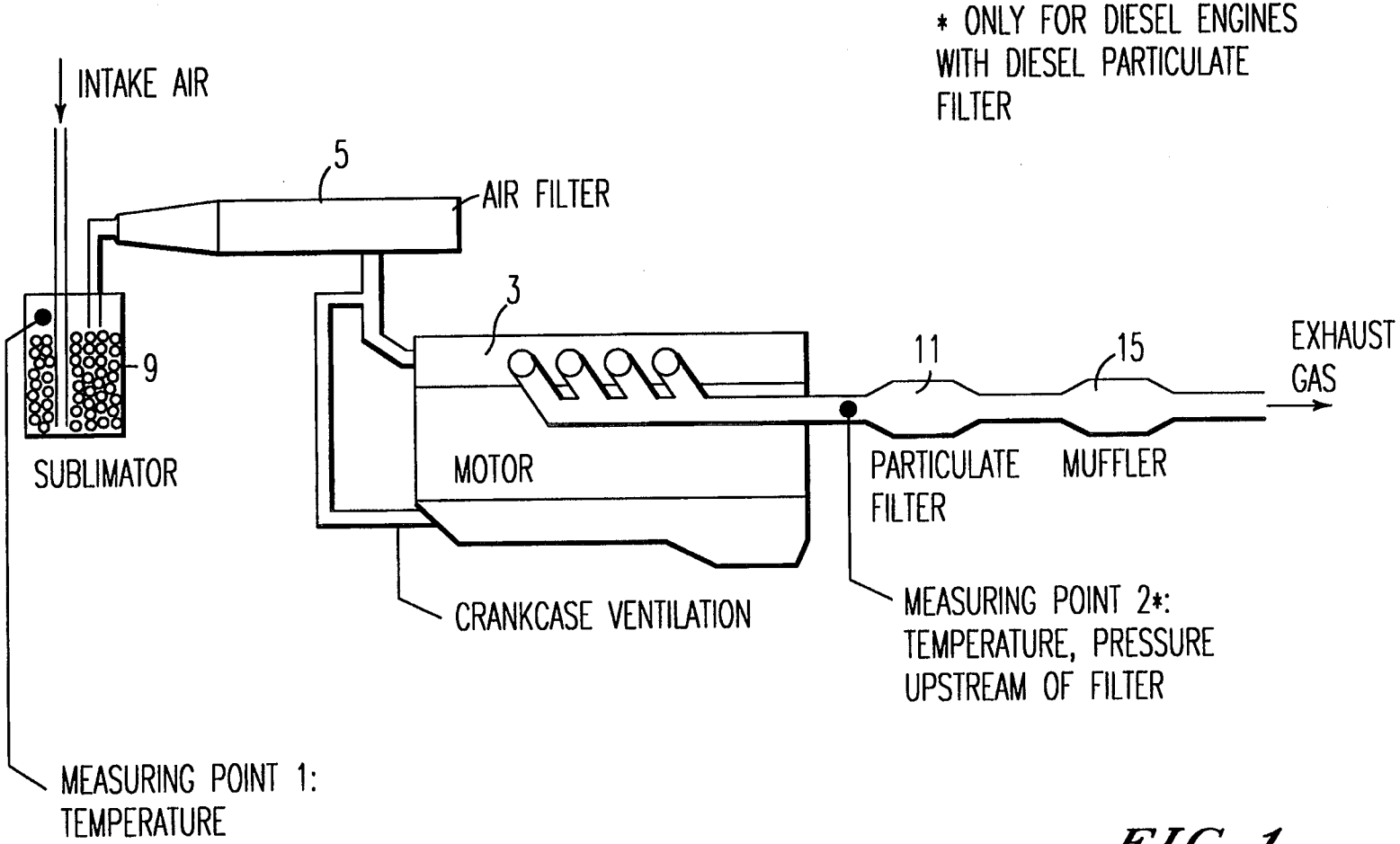
FIG. 1 shows an arrangement for charging a carrier gas stream with ferrocene.

Referring now to the drawings, wherein like reference numerals designate identical or corresponding parts throughout the several views, and more particularly to FIG. 1 thereof, FIG. 1 shows an arrangement in which a carrier gas stream is fed from an intake air pipe and is led by way of a sublimator 9, which is charged with compacts made of ferrocene and integrated into a motor vehicle engine 3.

In this arrangement the sublimator 9 is disposed upstream of an air filter 5 for the combustion air sucked in by the diesel engine. The venting of the crankcase is connected, as normal, downstream of the air filter to the pipe of the combustion air. Points 1 and 2 denote the measuring point for the temperature in the sublimator 9 or the temperature and the pressure upstream of a diesel particulate filter 11.

Figure 2:
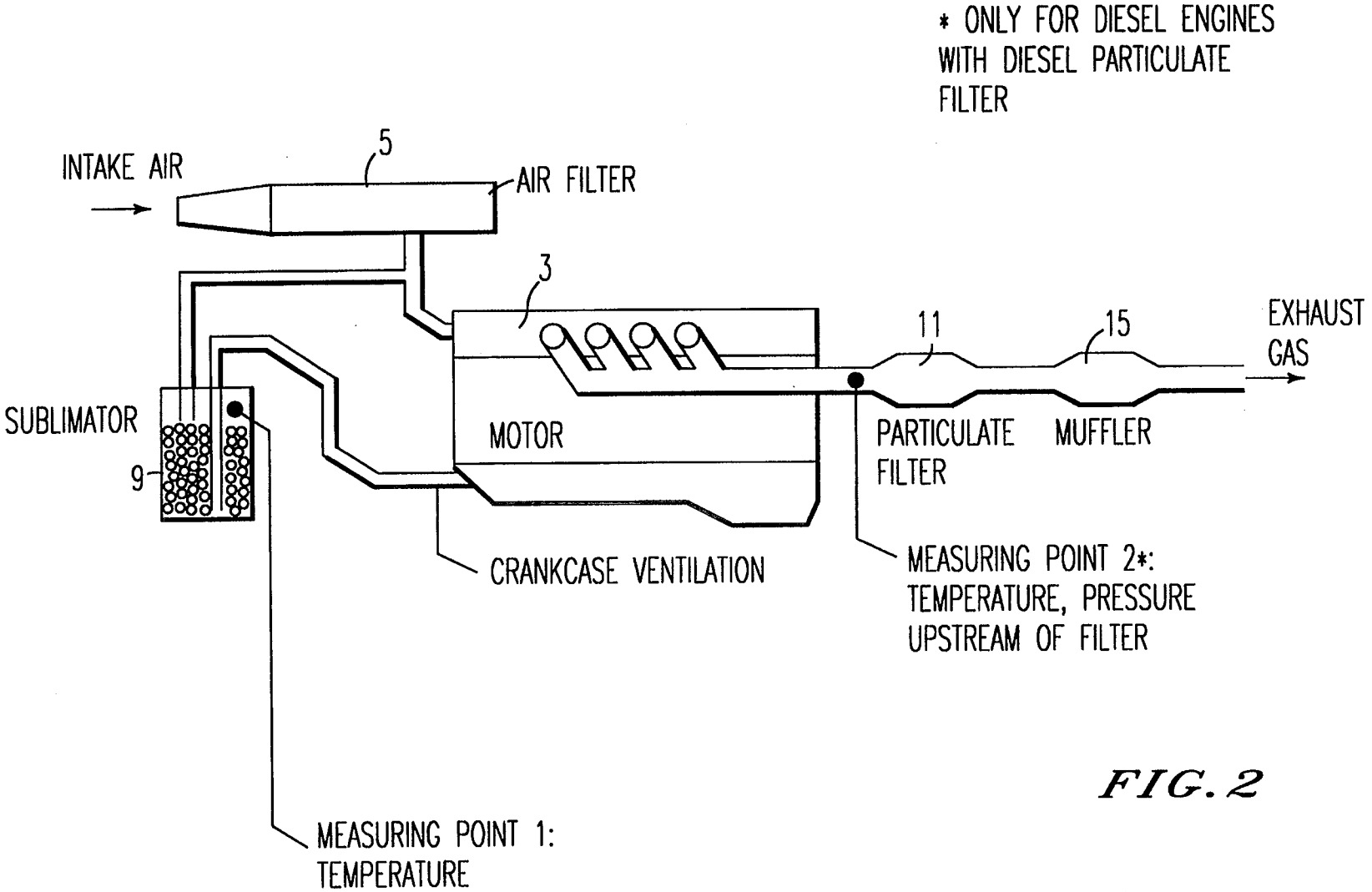
FIG. 2 shows a further embodiment for charging ferrocene.

FIG. 2 shows another modification for bringing in ferrocene.

The arrangements of FIGS. 1 and 2 are designed in detail to the effect that the carrier gas stream branches off from the intake air pipe provided in each motor vehicle engine or from the venting of the crankcase and is led in such a manner from there into the sublimator 9 loaded with received ferrocene pellets that a passage of the ferrocene vapor into the carrier vapor stream is brought about. The passage being as complete as possible under the selected pressure and temperature conditions. From the sublimator 9 the ferrocene-loaded carrier gas stream is united with the requisite amount of intake air downstream of the intake air filter 5 while avoiding condensation and led to the combustion chamber of the engine 3. The exhaust gas from the combustion of the fuel is released downstream of the engine by way of the particulate filter 11 and a muffler 15 into the atmosphere.

Points 1 and 2 denote the measuring points for the temperature in the sublimator 9 or for the temperature and the pressure before the combustion exhaust gases enter into the particulate filter 11.

Figure 3:
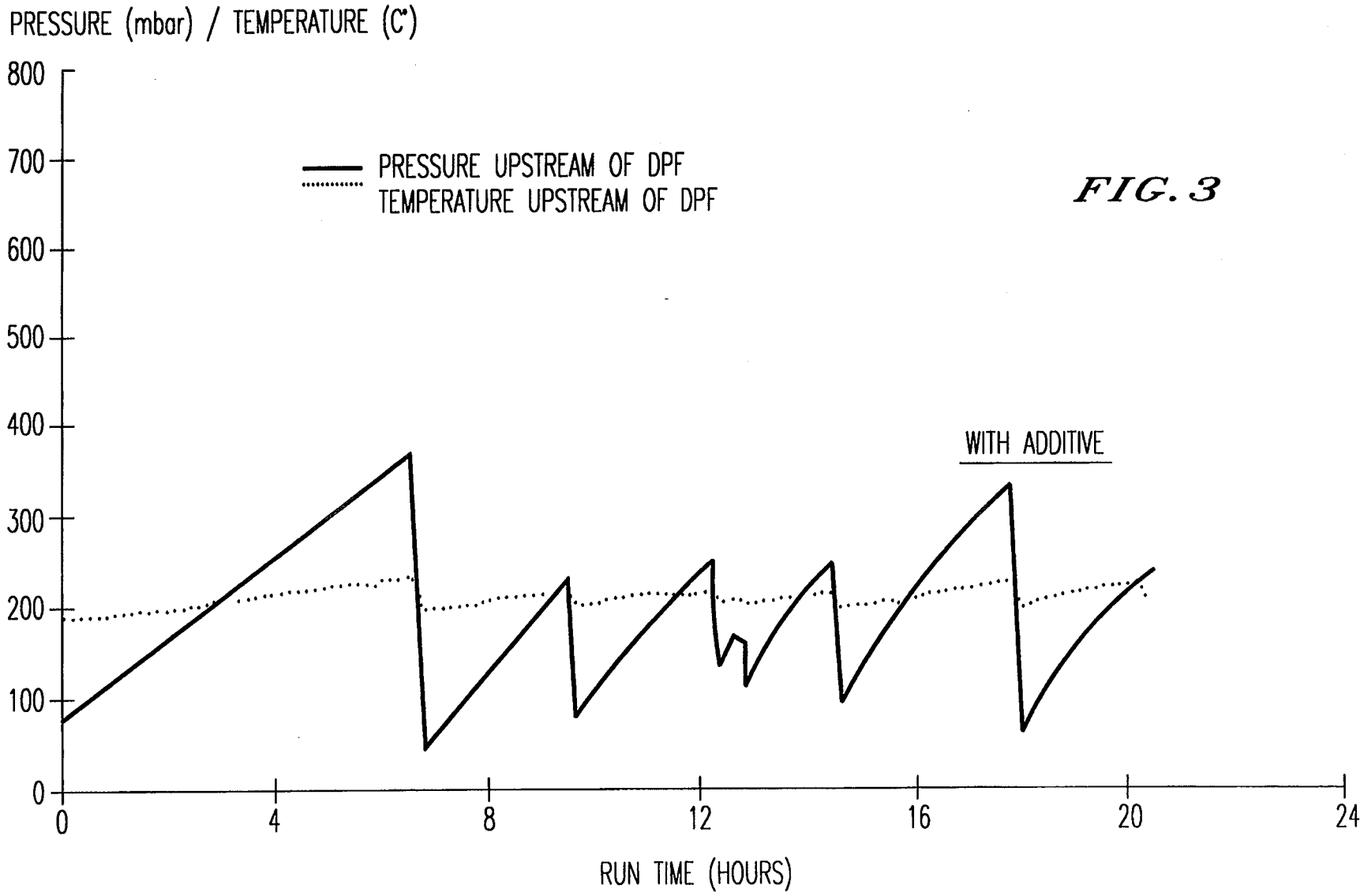
FIG. 3 shows a graph illustrating the burn-off behavior of a diesel particulate filter in a test conducted for 20 hours.

The graph according to FIG. 3 shows the results, obtained with such an arrangement, namely a sublimator filled with ferrocene pellets in the venting of the crankcase, with respect to the burn-off behavior of the diesel particulate filter in a long time test conducted for 20 hours.

In these tests a diesel fuel (clear) was used in accordance with the DIN specification (summer quality) with the following rating:

| | | |
|---|---|---|
| sulfur | % by wt. | 0.19 |
| density 15° C. | kg/m$^3$ | 839.9 |
| flash point | °C. | 65 |
| cloud point | °C. | 2 |
| CFPP | °C. | −5 |
| cetane number | | 52.2 |
| boiling situation | | |
| start of boiling | °C. | 163 |
| 5% | °C. | 189 |
| 10% | °C. | 204 |
| 20% | °C. | 225 |
| 30% | °C. | 245 |
| 40% | °C. | 262 |
| 50% | °C. | 278 |
| 60% | °C. | 293 |
| 70% | °C. | 310 |
| 80% | °C. | 328 |
| 90% | °C. | 353 |
| 95% | °C. | 370 |
| end of boiling | °C. | 380 |
| yield | % by vol. | 99 |
| beg. −250° C. | % by vol. | 33 |
| beg. −350° C. | % by vol. | 89 |

The test engine was operated with combustion air to which an additive had been added by way of the venting of the crankcase. The lubricant used belonged to the class SAE 15 W 40.

The test engine was a model of the manufacturer Opel 2.3 liter car engine, having free intake with swirl type combustion process and a nominal output of 54 kw.

The engine was run at 2,000 rpm and a load of 28 Nm torque (partial load). The temperature in the sublimator was about 40° C. In the diagram of FIG. 3 the dotted curve denotes the measured values of the temperature at the measurement point 2 in front of the diesel particulate filter 11. The solid, saw-toothed curve reproduces the change in the pressure upstream of the diesel particulate filter 11.

At the same time the pressure builds up from about 80 to 350 mbar on account of the deposit of carbon-containing particles in the combustion exhaust gas on the filter up to an operating period of about 7 hours. At this instant the diesel particulate filter 11 is regenerated by burning off the particulates collected in the filter, thus reducing the pressure to about 50 mbar. Subsequently an exhaust gas back pressure builds up again in accordance with the loading of the filter caused by the particulate emission of the diesel engine; then upon reaching values of about 200 to max, 350 mbar after a cycle time of about 2 to 3 hours, there is spontaneous burning, so that in total the operating behavior of the engine was acceptable over the run time.

Figure 4:
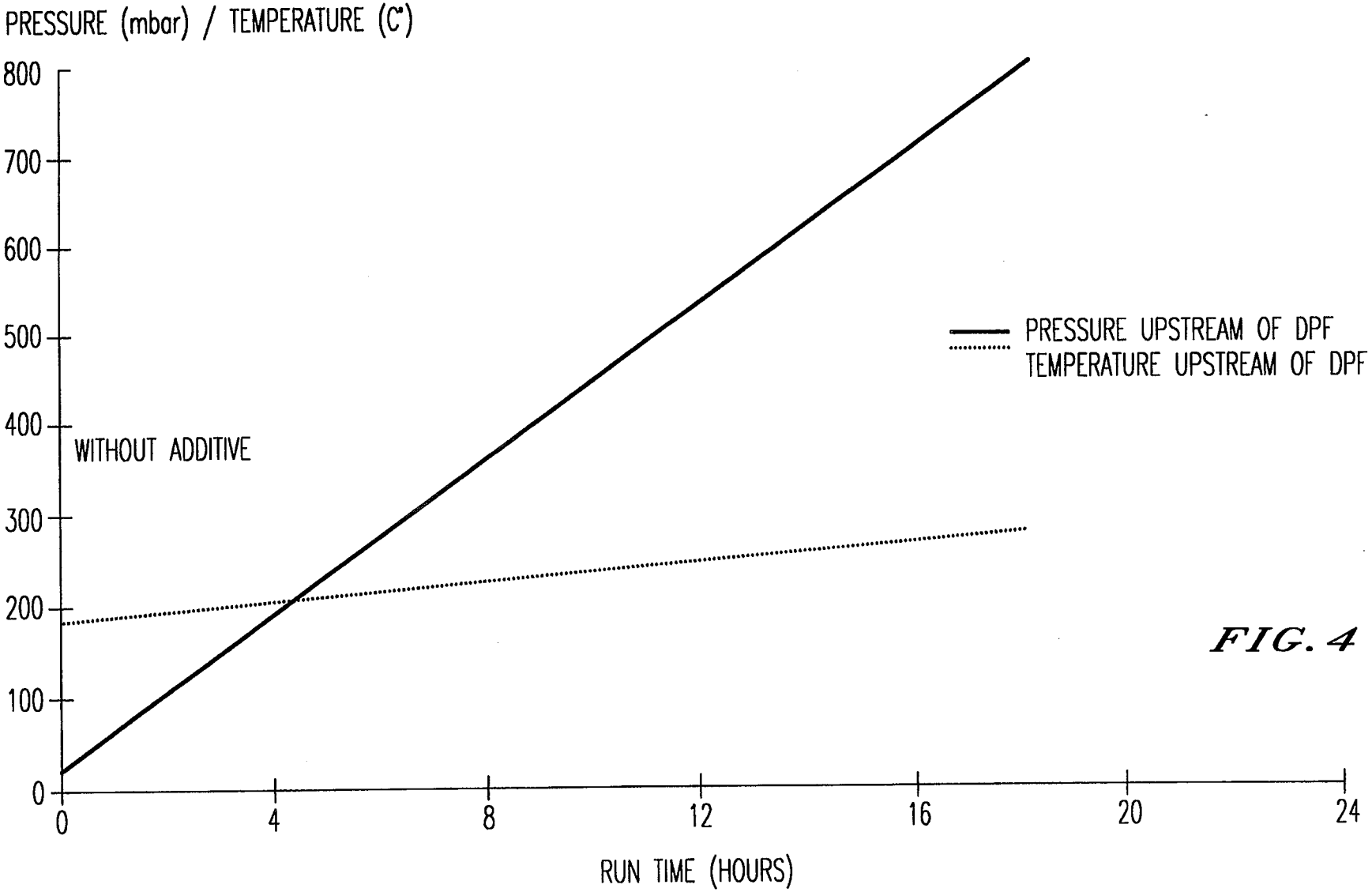
FIG. 4 shows a further long time test on the burning behavior of the diesel particulate filter.

For comparison purposes, FIG. 4 shows a long time test on the burning behavior of diesel particulate filter 11 under conditions comparable to those on which the diagram of FIG. 3 is based, with the single difference that no additive was added to the combustion air by means of a carrier gas stream from the venting of the crankcase. The arrangement also includes the sublimator 9 as shown in FIG. 2, but the sublimator was not charged with ferrocene pellets. At the same time the dotted curve shows the plotting of the temperature at measuring point 2 according to FIG. 2 upstream of the diesel particulate filter 11. It is apparent that here a slow, but constant rise from about 190° to about 280° C. was observed. The solid line shows an almost linear rise of the exhaust gas back pressure upstream of the diesel particulate filter 11 measured at measuring point 2 according to FIG. 2. Following a test period of about 18 hours, the exhaust gas back pressure had reached a value of 800 mbar, a value that does not in any way enable any more an acceptable operation of the engine. The test was therefore terminated. Even though the temperature at the measuring point 2 according to FIG. 2 had reached a value of about 280° C. at the instant the test was terminated, no burn-off of the diesel particulate filter 11 had taken place, whereas, according to the results according to FIG. 3, when ferrocene was added according to the invention, a burn-off took place at temperatures, measured at the same measuring point, of about 220° C.

The problem is solved advantageously with the proposed process, since an effective addition of the additive ferrocene during the combustion of liquid heating or motor fuels is guaranteed, when the operating data of the sublimator, the shape of the ferrocene substance as pellets, other moldings such as compacts or as a crystalline powder are specified subject to an expert making the choice.

The introduction of the carrier gas stream to which ferrocene is added into the combustion chamber significantly improves in Otto and Wankel engines with and without subsequent catalyst for the afterburning of the exhaust gas the combustion behavior in the engine, which is driven with commercially available motor fuels. In particular the occurrence of knocking in the engine is significantly suppressed. By changing the firing point the power output of the engine can be increased. When operating with the same power, the fuel consumption is reduced through the effect of the additive.

Figure 5:
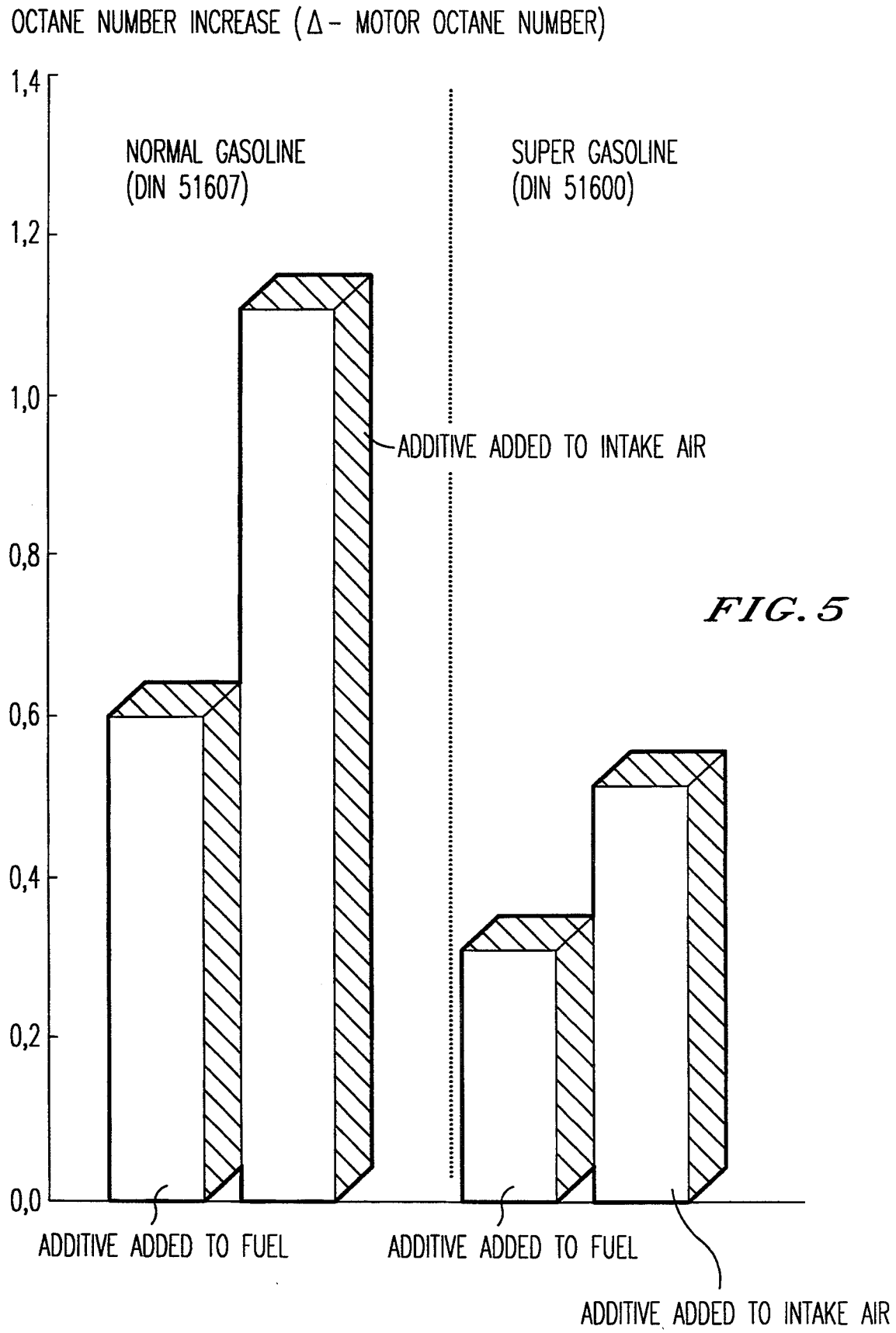
FIG. 5 shows comparison test data with respect to the suppression of knocking according to the present invention.

The suppression of knocking by introducing, according to the invention, the ferrocene additive is much higher than when the additive in the fuel is contained in the dissolved form. To this end, reference is made to the data with the related comparison test data in FIG. 5.

The introduction of ferrocene, according to the invention, into the engine process increases the combustion chamber cleanness by reducing the existing residue and preventing the build up of new deposits on pistons, piston rings, in the cylinder and cylinder head. In Otto engines without subsequent catalyst for the afterburning of the exhaust gas or reduction of pollutants, which are still equipped with exhaust valves, which are subject to wear, the addition of ferrocene acts as a wear-reducing component at the exhaust valve seat.

In diesel engines the introduction of ferrocene as an additive during fuel combustion in the combustion chamber results in the reduction of particulate emission and portions of polycyclic, aromatic hydrocarbons, which are attached to the carbon-containing particles.

Due to the addition of ferrocene according to the invention, the regenerability of a diesel particulate filter following a diesel engine is improved or enabled without additional devices to increase the temperature or to introduce operations to a periodic burning of the carbon-containing particles (diesel particulates) collecting on the filter for the purpose of maintaining low acceptable values for the pressure drop downstream of the filter.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A process for adding ferrocene to motor fuels for improving the combustion of the motor fuels with oxygen-containing gases, the process comprising the steps of:

admitting a carrier gas stream of combustion gas at pressure and temperature values in a range of coexistence between solid and gaseous phase ferrocene into a sublimator having pellets made of ferrocene crystals therein;

passing a vaporous ferrocene through sublimation in said sublimator into said carrier gas stream of combustion gas and leading the ferrocene-containing carrier gas stream from the sublimator into a combustion chamber of a diesel engine.

2. The process as claimed in claim 1, wherein:

said diesel engine is equipped with a diesel particulate filter.

3. The process as claimed in claim 1, wherein the carrier gas stream is fed by a crankcase vent pipe, and said sublimator is integrated into said engine.

4. The process as claimed in claim 1, wherein the ferrocene compacts are made of ferrocene crystals, which have a purity of at least 98.5% by wt. and which originate from a crystallizing solution and are wetted with solvent, without the addition of binders.

5. The process as claimed in claim 4, wherein the ferrocene compacts are made of ferrocene crystals wetted with ethanol.

6. The process as claimed in claim 1, wherein the sublimator is operated at a temperature of minus 40° to plus 150° C., a pressure of 100 mbar to 3 mbar and an evaporated quantity of ferrocene ranging from 0.1 to 1,000 mg per kg of fuel.

7. The process as claimed in claim 1, wherein the carrier gas stream is preheated to a temperature ranging from 20° to 175° C.

8. A process for adding ferrocene to motor fuels for improving the combustion of the motor fuels with oxygen-containing gases, the process comprising the steps of:

admitting a carrier gas stream of combustion gas at pressure and temperature values in a range of coexistence between solid and gaseous phase ferrocene into a sublimator having pellets made of ferrocene crystals therein;

passing a vaporous ferrocene through sublimation in said sublimator into said carrier gas stream of combustion gas and leading the ferrocene-containing carrier gas stream from the sublimator into a combustion chamber of a Wankel engine.

9. The process as claimed in claim 8 wherein: said Wankel engine includes an adjusted three-way catalyst for the afterburning of exhaust gas.

10. The process as claimed in claim 9, wherein the carrier gas stream is fed from an intake air pipe, and said sublimator is integrated into said engine.

11. The process as claimed in claim 8, wherein the carrier gas stream is fed by a crankcase vent pipe, and said sublimator is integrated into said engine.

12. The process as claimed in claim 8, wherein the ferrocene compacts are made of ferrocene crystals, which have a purity of at least 98.5% by wt. and which originate from a crystallizing solution and are wetted with solvent, without the addition of binders.

13. The process as claimed in claim 12, wherein the ferrocene compacts are made of ferrocene crystals wetted with ethanol.

14. The process as claimed in claim 8, wherein the sublimator is operated at a temperature of minus 40° to plus 150° C., a pressure of 100 mbar to 3 mbar and an evaporated quantity of ferrocene ranging from 0.1 to 1,000 mg per kg of fuel.

15.The process as claimed in claim 8, wherein the carrier gas stream is preheated to a temperature ranging from 20° to 175° C.

16. A process for adding ferrocene to motor fuels for improving the combustion of the motor fuels with oxygen-containing gases, the process comprising the steps of:

admitting a carrier gas stream of combustion gas at pressure and temperature values in a range of coexistence between solid and gaseous phase ferrocene into a sublimator having pellets made of ferrocene crystals therein;

passing a vaporous ferrocene through sublimation in said sublimator into said carrier gas stream of combustion gas; and leading the ferrocene-containing carrier gas stream from the sublimator into a combustion chamber of an Otto engine.

17. A process for adding ferrocene to motor fuels for improving the combustion of motor fuels with oxygen-containing gases, the process comprising the steps of:

subliming ferrocene from a sublimator having pellets made of ferrocene crystals therein with a carrier gas stream of a combustion gas at pressure and temperature values in the range of a coexistence line between solid and vaporous phase ferrocene; and burning a motor fuel with said stream of combustion gas including the vaporous ferrocene in a combustion chamber of a diesel engine.

* * * * *

UNITED STATES PATENT AND TRADEMARK OFFICE

CERTIFICATE OF CORRECTION

PATENT NO. : 5,386,804

DATED : February 7, 1995

INVENTOR(S) : Hansjuergen GUTTMANN et al.

It is certified that error appears in the above-indentified patent and that said Letters Patent is hereby corrected as shown below:

Column 7, line 6, change "3 mbar" to --3 bar--.

Signed and Sealed this

Eighteenth Day of July, 1995

*Attest:*

*Attesting Officer*

BRUCE LEHMAN

*Commissioner of Patents and Trademarks*